US010360780B2

(12) United States Patent
Balaji et al.

(10) Patent No.: US 10,360,780 B2
(45) Date of Patent: Jul. 23, 2019

(54) FIRE DETECTION DEVICE AND NOTIFICATION SYSTEM

(71) Applicants: Nandita Chakravarthy Balaji, Charlotte, NC (US); Shreyas Narayan Bhasin, Charlotte, NC (US); Kevin James Kaspar, Charlotte, NC (US); Zoe Paige Sherman, Matthews, NC (US)

(72) Inventors: Nandita Chakravarthy Balaji, Charlotte, NC (US); Shreyas Narayan Bhasin, Charlotte, NC (US); Kevin James Kaspar, Charlotte, NC (US); Zoe Paige Sherman, Matthews, NC (US)

( * ) Notice: Subject to any disclaimer, the term of this patent is extended or adjusted under 35 U.S.C. 154(b) by 0 days.

(21) Appl. No.: 16/014,991

(22) Filed: Jun. 21, 2018

(65) Prior Publication Data

US 2018/0374330 A1 Dec. 27, 2018

Related U.S. Application Data

(60) Provisional application No. 62/523,814, filed on Jun. 23, 2017.

(51) Int. Cl.

| | |
|---|---|
| ***G08B 17/00*** | (2006.01) |
| ***G08B 17/06*** | (2006.01) |
| ***G08B 29/14*** | (2006.01) |
| ***G08B 25/10*** | (2006.01) |
| ***G08B 25/00*** | (2006.01) |
| ***G08B 25/14*** | (2006.01) |
| ***G08B 17/10*** | (2006.01) |

(52) U.S. Cl.
CPC ..... *G08B 17/06* (2013.01); *G08B 17/10* (2013.01); *G08B 25/009* (2013.01); *G08B 25/10* (2013.01); *G08B 25/14* (2013.01); *G08B 29/145* (2013.01)

(58) Field of Classification Search
CPC ..... G08B 17/06; G08B 17/117; G08B 17/10; G01N 33/0075
USPC ..... 340/584, 628, 632
See application file for complete search history.

(56) References Cited

U.S. PATENT DOCUMENTS

| | | | | |
|---|---|---|---|---|
| 8,907,799 | B2 * | 12/2014 | McKenna | G08B 17/06 340/584 |
| 9,619,996 | B1 * | 4/2017 | Smith | A62C 3/02 |
| 9,666,050 | B2 * | 5/2017 | Wu | G08B 17/005 |
| 9,928,709 | B2 * | 3/2018 | Takasu | G08B 25/14 340/539.26 |

(Continued)

*Primary Examiner* — Toan N Pham
(74) *Attorney, Agent, or Firm* — Moore & Van Allen PLLC; W. Kevin Ransom

(57) ABSTRACT

Embodiments of the present invention relate to, in general, a fire detection device and notification system configured for generating alerts based on detected environmental conditions (e.g., temperature, humidity, presence of flame or smoke or combustion gas). In some embodiments, the fire detection device employs various sensor devices (e.g., temperature, humidity, flame, smoke, gas, and the like) to collect environmental data and determine whether the detected environmental conditions indicate the presence of or the increased possibility of a fire. In some embodiments, the invention further comprises a notification system for automatically generating and transmitting alerts to one or more computing devices (e.g., responder dispatch systems) based on the detection of hazardous conditions.

8 Claims, 13 Drawing Sheets

(56) References Cited

U.S. PATENT DOCUMENTS

2013/0321149 A1* 12/2013 Ben-Shmuel ..... G08B 17/005
340/539.26

* cited by examiner

FIRE DETECTION DEVICE AND NOTIFICATION SYSTEM

CROSS-REFERENCE TO RELATED APPLICATIONS

This application is a non-provisional filing of U.S. Provisional Application No. 62/523,814 filed Jun. 23, 2017, the contents of which are hereby incorporated by reference herein.

FIELD OF THE INVENTION

The present invention relates to a device for detection of a fire and a system and method for alerting appropriate responders of a detected fire in a selected area, for example in a remote, forested location.

BACKGROUND OF THE INVENTION

Each year, naturally occurring and manmade forest fires and wildfires burn millions of acres of private, state, and federal land. Forest fire detection and notification systems have historically relied on human, visual monitoring of forested areas; however, due to the existence of large tracts of sparsely populated or uninhabited woodland areas (e.g., national parks/forests, nature preserves, and the like) as well as delayed, initial detection of fires, this method can prove ineffective. As such, there is a need for an automatic, remote monitoring and detection system to aid the prevention and control of forest fires.

BRIEF SUMMARY OF THE INVENTION

The following presents a summary of one or more embodiments of the invention in order to provide a basic understanding of such embodiments. This summary is not an extensive overview of all contemplated embodiments, and is not intended to identify key or critical elements of all embodiments or delineate the scope of any or all embodiments. The sole purpose of the brief summary is to present some concepts of one or more embodiments in a summary form as a prelude to the more detailed description that is presented later.

A fire detection device is provided comprising a temperature sensor and a flame sensor at least partially housed within an interior cavity formed by a vessel of the fire detection device. The temperature sensor and the flame sensor collect environmental data from an environment in which the fire detection device is positioned. The fire detection device further comprises a communication device connected to a network, wherein the communication device transmits an alert to another computing device based on the collected environmental data. In one embodiment, the fire detection device comprises a smoke sensor. In another embodiment, the fire detection device comprises a humidity sensor.

In yet another embodiment, the vessel of the fire detection device comprises a fireproof or fire resistant material. In yet another embodiment, the fire detection device comprises fireproof or fire resistant insulation within the interior cavity of the vessel. In yet another embodiment, the fire detection device comprises a secondary enclosure positioned within the vessel, the secondary enclosure and the vessel forming a space therebetween, and a fireproof or fire resistant insulation positioned within the space. In yet another embodiment, the fireproof or fire resistant insulation is a sprayable foam insulation, the sprayable foam insulation being expandable to fill the space formed between the interior of the vessel and the secondary enclosure.

In yet another embodiment, the fire detection device comprises a power storage device operatively coupled to an energy collection device, wherein the power storage device stores energy collected by the energy collection device. In yet another embodiment, the energy collection device is a solar panel. In yet another embodiment, the fire detection device further comprises a support frame securable to a surface of the environment, the support frame forming a platform to support the vessel and the fire detection device as a whole.

A fire detection device network is also provided, the network comprising a plurality of fire detection devices in communication over a network. Each of the plurality of fire detection devices comprises a sensor device, a memory device with computer-readable program code stored thereon, a communication device in communication with the network, and a processing device. The processing device is operatively coupled to the sensor device, the memory device, and the communication device. The processor is configured to execute the computer-readable program code to collect environmental data via the sensor device, determine a hazardous environmental condition, generate an alert based on determining the hazardous environmental condition, and transmit the alert. In one embodiment, the alert comprises the hazardous environmental condition and a location associated with at least one of the plurality of fire detection devices.

In another embodiment, at least some of the plurality of fire detection devices remain in a dormant state until determining the hazardous environmental condition. In yet another embodiment, the alert is transmitted from a first fire detection device to a second fire detection device in the dormant state, wherein receiving the alert causes the second fire detection device to operate in an active state, wherein the second fire detection device collects and processes environmental data in the active state. In yet another embodiment, a first fire detection device in an active state utilizes processing power of a second fire detection device in the dormant state over the network.

In yet another embodiment, the fire detection device network further comprises a user device having an interactive user application stored thereon and in communication with the network, wherein the alert is received by the user device. In yet another embodiment, the interactive user application is configured to generate a map based on the alert.

A fire detection device is also provided, the fire detection device comprising a vessel forming an interior cavity and at least one environmental sensor device positioned at least partially within the interior cavity of the vessel. The at least one environmental sensor device collects environmental data from an environment. The fire detection device further includes a communication device connected to a network, wherein the communication device transmits an alert to a computing device based on the environmental data collected by the at least one environmental sensor device. In one embodiment, the vessel of the fire detection device comprises a fireproof or fire resistant material. In another embodiment, the at least one environmental sensor device is selected from the group consisting a temperature sensor, a humidity sensor, a smoke sensor, a flame sensor, and a gas sensor.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION OF EMBODIMENTS OF THE INVENTION

Figure 1:
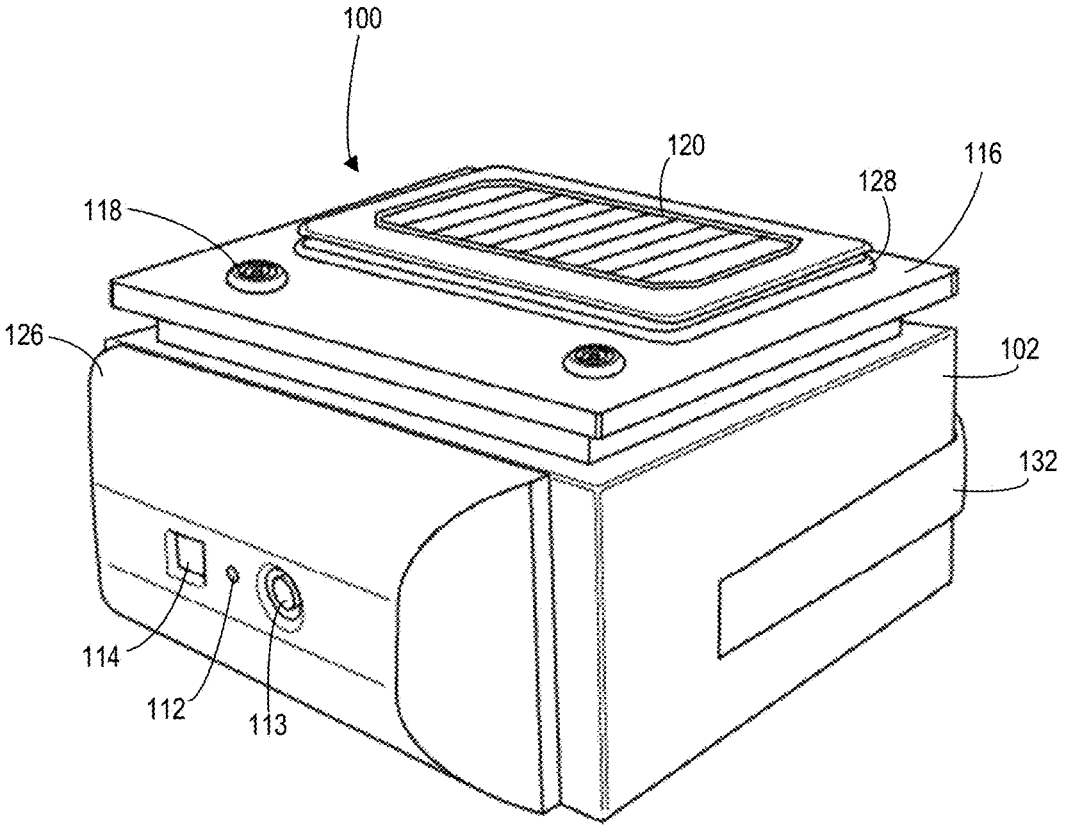
FIG. 1 depicts a perspective view of a fire detection device in a closed state, in accordance with one embodiment of the invention.

Embodiments of the present invention provide a device and system for fire detection in a selected area, such as for example, in remote forested locations or other areas that are either not readily accessible or not frequently visited for visual inspection. The invention further provides a networked communication system for generating and providing fire alert notifications to one or more parties of interest, such as emergency response organizations or systems, nearby residents, and/or the like. In some embodiments, the fire detection device generally comprises a fire retardant or fire resistant vessel containing one or more computing controller devices, network devices, and sensor devices for collecting environmental data from, typically, an outdoor environment (e.g., a forest). Sensor devices may include temperature sensors, humidity sensors, anemometers, flame, smoke, and gas detection devices, among others, for, respectively, measuring temperature, humidity, air flow, flame, smoke and/or specific combustion gas presence. In response to detecting one or more hazardous environmental conditions (e.g., high temperature, low humidity, and the presence of flame, smoke, and/or particular gases indicating a fire), an alert is generated and transmitted over the networked notification system to one or more computing devices or systems allowing for appropriate action to be initiated as soon as possible to counter the detected hazard.

It is contemplated that the fire detection device may be deployed in a remote location for long periods of time, and further, the fire detection device may be consumed in a fire or otherwise unrecoverable. Further, where possible, the fire detection device itself is constructed using low cost, durable component parts, making the cost of replacement of the device or its components reasonable. The device may employ a solar panel or like apparatus for generation of energy, coupled with a rechargeable battery system for energy storage, allowing the system to be self-sufficient in a remote area. As such, in some embodiments, the fire detection device is designed and manufactured for long deployments in rugged conditions and, where possible, with low cost components in order to reduce manufacturing and maintenance costs while anticipating instances when the device will likely not be recoverable (i.e., one-time use). Due to the modular design of the fire detection device, one or more sensors or other components may be individually replaced after becoming damaged. As will be discussed below, the fire detection device, according to one or more embodiments, may be constructed with a low cost, fireproof, water resistant/proof container or vessel of either light weight metal and/or with a rigid insulation and/or lining to protect the components of the device from hazardous environmental conditions (e.g., heat and fire).

As an example, in one embodiment, the fire detection device may use a Raspberry Pi® computing system. Such a computing system is an independent computer that can run an operating system in Linux. The computing system may multitask, support multiple (e.g., two) USB ports, and connect wirelessly to the Internet. It is considered powerful enough to function as a personal computer, but in a low cost, efficient manner. In other embodiments, the fire detection device may include a microcontroller configured to control and instruct one or more components of the fire detection device and execute one or more of the steps as described herein. By employing a microcontroller as a controlling computing system in the fire detection device, energy efficiency of the device may be increased due to the relatively small energy requirements of the microcontroller.

With the above in mind, embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. In the drawings, like reference characters and numbers refer to like elements throughout. Also, the drawings are not necessarily to scale, emphasis instead generally being placed upon illustrating the principles of the disclosure. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together. Furthermore, "electronically coupled," when used herein, may mean that the components may be operatively coupled and further allow for the transmission of electricity and/or signals between components.

A "user" as used herein may refer to any entity or individual associated with the fire detection device and notification system such as a user of a computing device and/or mobile application. A user may also be a responder (e.g., firefighter, police, medical responder) or the like that may provide aid or support in response to a hazard detected by the fire detection device and notification system. A user may also be a person, entity, organization, government agency, or the like with an interest in collection and analysis of environmental data. Furthermore, as used herein the term "user device" may refer to any device that employs a processor and memory and can perform computing functions, such as a personal computer or a mobile device, wherein a mobile device is any mobile communication device, such as a cellular telecommunications device (i.e., a cell phone or mobile phone), personal digital assistant (PDA), a mobile Internet accessing device, or other mobile device. Other types of mobile devices may include portable digital assistants (PDAs), pagers, wearable devices, mobile televisions, gaming devices, laptop computers, cameras, video recorders, audio/video player, radio, global positioning system (GPS) devices, or any combination of the aforementioned. A user device may further include a responder dispatch system, an emergency broadcast system, and the like.

"Authentication information" is any information that can be used to identify the identity of a user. For example, a system may prompt a user to enter authentication information such as a username, a password, a personal identification number (PIN), a passcode, biometric information (e.g., voice authentication, a fingerprint, and/or a retina scan), an answer to a security question, a unique intrinsic user activity, such as making a predefined motion with a user device. This authentication information may be used to authenticate the identity of the user (e.g., determine that the authentication information is associated with an account) and determine that the user has authority to access the account (i.e., login), device, and/or system.

To "monitor" is to watch, observe, or check something for a special purpose over a period of time. The "monitoring" may occur periodically over the period of time, or the monitoring may occur continuously over the period of time. In some embodiments, a system may actively monitor an environment (e.g., a forested area), wherein the system reaches out to one or more sensor devices and data collection systems and watches, observes, or checks the environment for changes, updates, and the like. In other embodiments, a system may passively monitor an environment, wherein the database provides information to the system and the system then watches, observes, or checks the provided information.

FIGS. 1-4 provide a collection of view of a fire detection device 100, in accordance with embodiments of the invention. The fire detection device 100 generally comprises a container or vessel 102 such as a box having side walls that form an interior cavity, as presented in FIG. 1. In some embodiments, the vessel 102 may be any three-dimensional shape that is at least partially hollow to allow for storage of additional components or devices within the formed interior cavity. In some embodiments, the vessel 102 is constructed from a material that is substantially fireproof, fire resistant, and/or fire retardant, wherein degradation of the material of the vessel 102 by fire, flame, or heat may be reduced or inhibited. In some embodiments, the vessel 102 is constructed from stainless steel. In other embodiments, it may be constructed of other metals, such as aluminum. Further, in some embodiments, the vessel may be constructed of ceramic material, rigid and durable foam, temperature resistant plastics, or any other durable, fire resistant material. In some embodiments, the vessel 102 may be waterproof or water-resistant, wherein water or moisture is at least partially prevented, by physical or chemical (e.g., material properties, added coatings) means, from penetrating the interior cavity of the vessel 102. In other embodiments, one or more side walls of the vessel 102 may be at least partially open (i.e., having holes) or constructed from a screen or mesh to allow external stimuli (e.g., air flow, heat, flame, light, smoke, gases, moisture, or the like) to access the interior of the vessel 102. Alternatively, the partial openings may also allow for one or more components at least partially contained within the interior of the vessel 102 to have access to the exterior of the vessel and a surrounding environment. Other structures for allowing sensors within the vessel to be in communication with the surrounding environment are envisioned.

The vessel 102 may further comprise at least one opening or door 116 hingeably attached to a side of the vessel 102, the door 166 separating and providing a pathway between an interior and exterior of the vessel 102. In other embodiments, the door 116 may simply be a removable panel or the like that is operatively coupled to a side of the vessel 102 and is not hingeably attached. In some embodiments, the door 116 of the vessel 102 may further comprise a sealing element proximate to one or more edges of the door 116 to provide a seal and prevent the incursion of water and/or other unwanted material (e.g., debris, insects, or the like) to the interior of the vessel 102. The vessel 102 may further comprise one or more locking mechanisms and/or latches 118 operatively coupled to the door 116 and accessible from the exterior of the vessel 102. In these ways, a user may have access to the interior of the vessel 102 while still providing a barrier and protection for the contents of the vessel 102. The fire detection device 100 itself may be operatively coupled or attached (e.g., with adhesive material, bolts, screws, straps, and/or the like) to a surface (e.g., a tree trunk) of an environment of interest in which environmental data will be collected. In other embodiments, the fire detection device 100 may be simply placed or positioned within the environment of interest (e.g., on the ground or other surface). In a specific embodiment illustrated in FIGS. 5 and 6, the fire detection device 100 may be partially secured to an object such as a tree using a strap 132.

In some embodiments, insulation 104 may be operatively coupled to one or more sides of either the interior or the exterior of the vessel 102. The insulation 104 may provide an additional physical and/or chemical barrier between the surrounding environment and an interior of the vessel 102. In some embodiments, the insulation 104 may be a heat-resistant and/or flame or fire resistant/retardant synthetic or natural (treated or untreated) material. In some embodiments, the insulation 104 may be a sprayable, foam insulation that expands to fill a space in which it was applied and/or form to the shape of the interior or exterior of the vessel. In other embodiments, the insulation 104 may be a fabric or fiber-based material such as an aramid material (e.g., Nomex®). In still other embodiments, the insulating material may be incorporated into the sides of the vessel 102 itself, wherein additional insulation is unnecessary.

In some embodiments, the vessel 102 of the fire detection device 100 further includes one or more additional walls or barriers within the interior cavity of the vessel 102 to further protect the contents of the fire detection device 100 and define the interior cavity. In the illustrated embodiment, the additional interior walls of the fire detection device 100 form a secondary enclosure 122 that encases one or more components stored within the vessel 102 within a secondary cavity. In some embodiments, the secondary enclosure 122 may be formed in a shape similar to that of the exterior vessel 102. In one embodiment, the secondary enclosure 122 may be laser cut to retain dimensions and/or precisions relative to the exterior vessel 102 or in order to adequately accommodate components (i.e., size and shape) within the interior cavity formed by the fire detection device 100. In other embodiments, the interior, secondary enclosure 122 may be formed in a shape that is different than that of the exterior vessel 102. In some embodiments, the secondary enclosure 122 may be constructed from fireproof or fire resistant materials described herein.

In some embodiments, the insulation 104 is positioned in a space formed between the side walls of the vessel 102 and the interior, secondary enclosure 122. In a specific embodiment, wherein the insulation 104 is a sprayable foam, the insulation 104 may be applied to the space, wherein the insulation 104 expands to fill the space formed between the side walls of the vessel 102 and the secondary enclosure 122. In this way, the interior, secondary enclosure 122 along with the vessel 102 may retain and provide shape to the insulation 104 as it fills the space by providing boundaries for expansion of the insulation 104. Further, the secondary enclosure 122 separates and/or protects components stored within the fire detection device 100 from potential adverse effects experienced as a result of coming into contact with the insulation 104. The secondary enclosure 122 may further provide a flat or level surface on which to mount one or more of the components within the defined interior cavity of the fire detection device 100.

Figure 2:
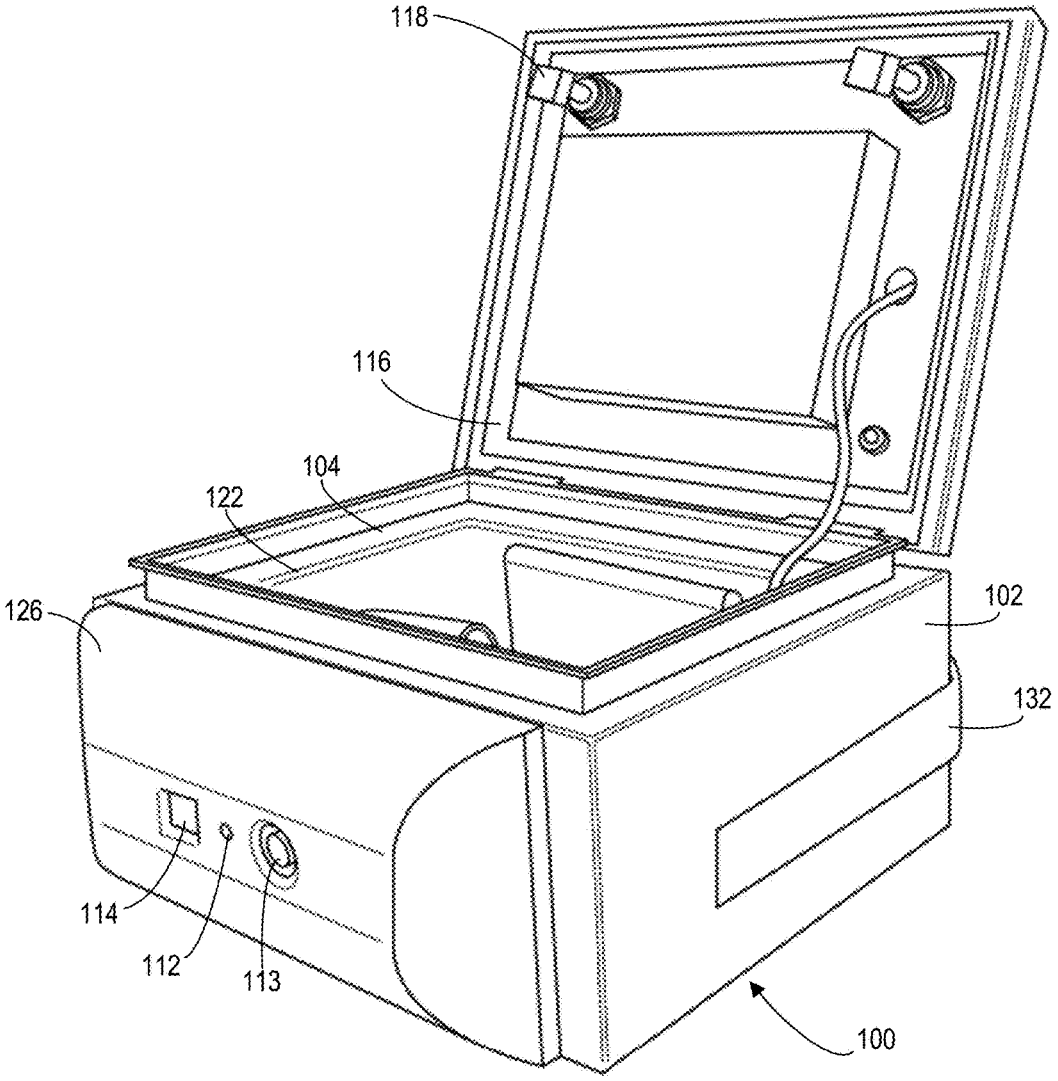
FIG. 2 depicts a perspective view of a fire detection device in an open state, in accordance with one embodiment of the invention.

In some embodiments, such as the embodiment illustrated in FIG. 2, a portion of the insulation 104 and/or the secondary enclosure 122 may be coupled to an interior surface of the door 116, wherein opening the door 116 temporarily removes the portion of the insulation 104 and/or the secondary enclosure 122 with the door to provide access to the interior cavity of the fire detection device 100.

As previously discussed, the fire detection device 100 further comprises one or more components and devices stored, at least partially, within the interior of the vessel 102. The one or more components and devices of the fire detection device 100 may be operatively coupled or attached (e.g., with adhesive material, bolts, screws, and/or the like) to an interior surface of the vessel 102. In some embodiments, the insulation 104 may be used to operatively couple or fix in place the one or more components and devices within the interior of the vessel 102. In some embodiments, the components may be partially or completely encapsulated in insulation for added protection. In yet other embodiments, the components may be positioned on a surface of the secondary enclosure 122 as previously described herein.

Figure 3:
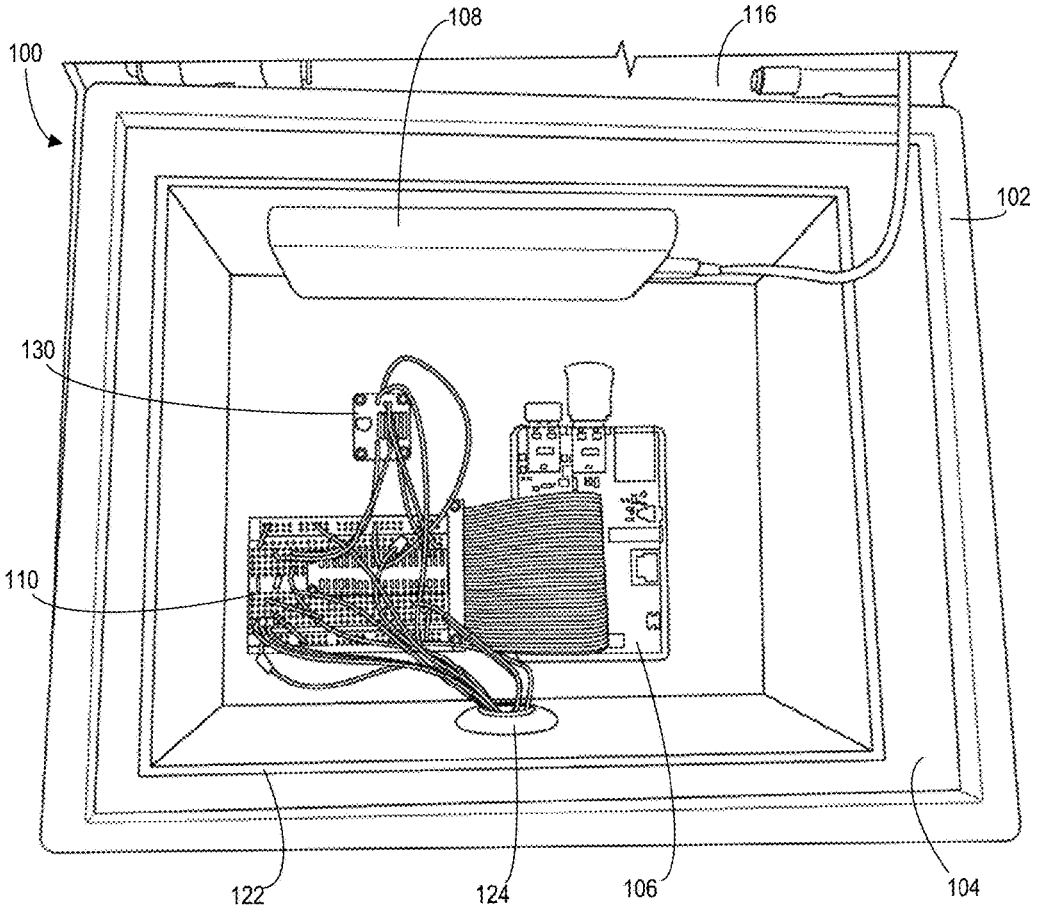
FIG. 3 depicts an interior view of a fire detection device, in accordance with one embodiment of the invention.

As illustrated in FIG. 3, in some embodiments, the fire detection device 100 may comprise a controller device 106. The controller device 106 may be a computing device having a processor and a memory for controlling and instructing one or more other components and devices of the fire detection device 100. In some embodiments, the controller device 106 may further comprise a communication device for transmitting and receiving data and instructions to and from the fire detection device 100. Data may be transmitted and received to and from the device 100 via a wired and/or wireless (e.g., Wi-Fi, satellite, cellular network, or the like) connection. For example, a user may transmit operating instructions to one or more fire detection devices 100 such as instructions for types of environmental data to collect or thresholds for triggering generation of an alert and/or other functions. The controller device 106 may be operatively and/or electronically coupled to one or more additional devices of the fire detection device 100 such as a power source 108 or power storage device (e.g., a rechargeable battery), electronic connection board 110, and one or more sensor devices, as discussed below.

Figure 4:
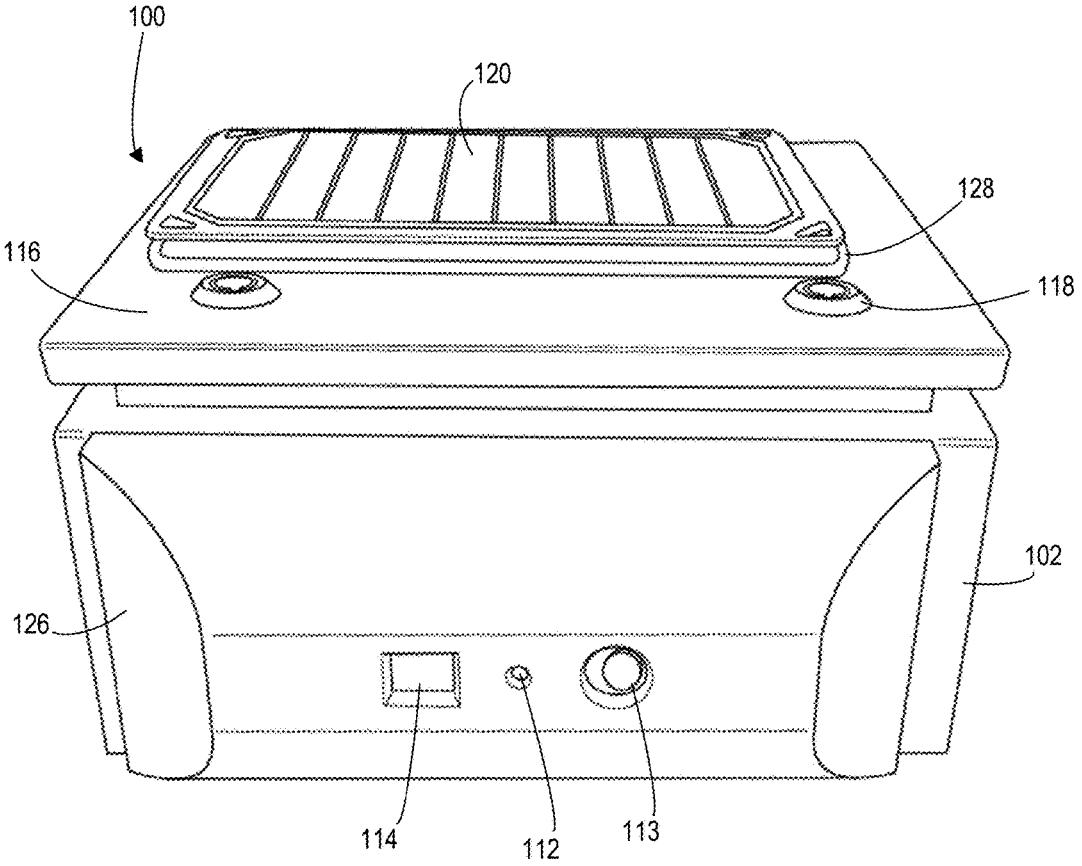
FIG. 4 depicts a perspective view of a fire detection device, in accordance with one embodiment of the invention.

The fire detection device 100 may further comprise a power source 108 that provides power to the one or more of the devices and components of the fire detection device 100. The power source 108 may be a rechargeable battery (e.g., a lithium-ion battery) electronically coupled to the one or more other devices and components of the fire detection device 100, such as the controller device 106, electronic connection board 110, and the one or more sensor devices. The power source 108 may be further coupled to one or more solar panels 120 (as illustrated in FIGS. 1 and 4) that provide a source of renewable energy to the power source 108 or may be coupled to another form of renewable energy, such as a windmill electrical generator, wherein the fire detection device 100 may comprise a collection device for the renewable energy. In some embodiments, where the fire detection device 100 is located in or near a facility, the device 100 may include an electrical connector for connection to a power grid. Any form of energy generation and usage is contemplated.

As previously discussed, the fire detection device 100 may comprise one or more solar panels 120 operatively coupled to an exterior surface of the vessel 102 and electronically coupled to rechargeable power source 108 used to power the device. In one embodiment, the solar panel 120 may be electronically coupled to the power source 108 via a wire passing through a hole in a side wall (e.g., door 106) of the vessel 102. In some embodiments, the solar panel 120 may be encapsulated in glass or epoxy for purposes of fireproofing. In some embodiments, the solar panel 120 is operably coupled to the vessel 102 via a mount 128 that secures and stabilizes the solar panel 120 on the fire detection device 100 and assists in preventing the solar panel 120 from becoming misaligned as a result of external forces (e.g., wind, debris, wildlife, or the like).

As further depicted in FIG. 3, the fire detection device 100 may further comprise an electronic connection board 110 within the interior of the vessel 102. The electronic connection device 110 may be electronically coupled to the controller device 106 and the one or more other devices and components of the fire detection device 100. In some embodiments, the electronic connection board 110 provides an intermediate electronic connection management system between the controller device 106 and the one or more sensor devices (e.g., temperature, humidity, anemometer, flame, smoke, or gas sensor, and the like) of the fire detection device 100. The electronic connection board 110 may provide a structure for electronic connection of one or more devices and allow for construction of a circuit for operation of the devices. In some embodiments, the electronic connection board 110 may be a reusable, solderless breadboard that allows for easy manipulation, addition, and/or removal of one or more coupled device. In other embodiments, the electronic connection board 110 may be a printed circuit board (PCB) such as a motherboard or Arduino board. Wires may be used to electronically couple or establish connections between the electronic connection board 110 and one or more connected devices to allow for the transmission of power and/or signals. In some embodiments, the controller device 106 and the electronic connection board 110 may be a single device.

As previously discussed, the fire detection device 100 comprises one or more sensor devices for collecting data (e.g., temperature, humidity, flame, smoke or gas presence, wind direction and speed, and the like) from the environment (e.g., a forest) surrounding the fire detection device 100. The one or more sensor devices convert the measured or detected external stimuli into one or more electronic signals which may be processed by the fire detection device 100. In some embodiments, the one or more sensor devices may further comprise data logging devices electronically coupled to the one or more sensor devices to process collected signals received from the sensor devices and transform the signals into a data format compatible with other computing devices (e.g., a user computing device) for further processing and analysis by another system, program, and/or user. In some embodiments, the fire detection device 100 may include an analog-to-digital converter 130 for transforming analog signals generated by the one or more sensors into digital signals that may be collected, processed, and/or transmitted by the fire detection device 100 and/or communication network described herein. In other embodiments, the analog-to-digital converter 130 may be integrated into another component or device (e.g. a sensor) described herein.

The one or more sensors of the fire detection device 100 may comprise an integrated temperature and humidity sensor device 114. In some embodiments the temperature and humidity sensor device 114 comprises a thermocouple and a hygrometer to measure temperature and air moisture content of a surrounding environment respectively. An example of such device is a DHT22 temperature and humidity sensor sold under the brand name of Evazstyle™. In other embodiments, the fire detection device 100 may use a thermometer to measure temperature.

The fire detection device 100 may further comprise a flame sensor 112 to detect the presence of a flame or fire in the surrounding environment. The flame sensor 112 may detect the presence of flame or fire by collecting one or more of light (e.g., ultraviolet, infrared, near-infrared, visible and/or the like), heat (i.e., via a thermocouple) or heat and humidity (i.e., via a hygrometer), ionization energy (i.e., via flame rectification), and/or smoke or gases to generate and electrical signal that is able to be processed and analyzed by the device 100 and system.

In some embodiments, as noted above, the fire detection device 100, may include a smoke and/or gas detector 113. Smoke detectors typically employ either an optical sensor or ionization sensor. In optical sensor systems, smoke is detected when smoke enters the detector and disrupts propagation of a light beam from a light source to an optical sensor thereby triggering an alarm. Ionization detectors operate by use of an ionization chamber that produces a current across electrodes. When smoke particles enter the detector, they attach themselves to ions in the ionization chamber and disrupt electrical current flow triggering the sensor. In some embodiments, the smoke detector 113 is configured to detect a smoke or particle concentration in a collected air sample.

In some embodiments, gas detectors may be employed. The presence of several different types of combustion gases may be indicative of fire. A few examples of these gases are carbon monoxide, carbon dioxide, nitrogen oxides, ammonia, sulfur, and hydrogen. Colorimetric gas sensors, sensitive field effect transistors, and metal oxide sensors are typical gas sensing systems for fire detection, which may be used in the fire detection device. The following article provides information regarding various gas sensors: Hoefer, Ulrich and Gutmacher, Daniel, "Fire gas detection," *Procedia Engineering,* 47 (2012), 1446-1459 (also published online at: http://www.sciencedirect.com/science/article/pii/S1877705812044931). The contents of this article are also incorporated by reference herein. In some embodiments, the fire detection device 100, may further comprise additional sensor devices such as an anemometer, weather vane, an image capture device, a sound recording device, a geolocation device, a weather sensing device, a proximity sensor, a motion sensor, radio frequency sensor, pressure sensor, a pH sensor, radiation measurement and detection devices (e.g., a Geiger counter and/or the like), biological contaminant sensing devices, a photoelectric sensor, a capacitance sensor, an electric field sensor, a magnetic field sensor, a piezoresistive or piezoelectric sensor, and the like.

As previously discussed, the one or more sensor devices may extend at least partially through one or more sides of the vessel 102 to collect environmental data on the exterior of the fire detection device 100. Insulation, such as insulation 104, a sealant, or the like may be used to surround and secure the one or more sensor devices and/or connecting wires extending at least partially through the vessel 102. In this way, the physical and/or chemical barrier between the interior and exterior of the vessel 102 may be maintained while allowing for one or more devices or components to extend at least partially from the interior to the exterior of the vessel 102. In a specific embodiment, such as the embodiment illustrated in FIG. 3, the sensors and/or wires connecting the sensors to the interior components of the fire detection device 100 may pass through a protective guide 124 positioned within a hole in a side of the vessel 102 allowing the sensors and/or wiring to extend to the exterior of the fire detection device 100. The protective guide 124 may be constructed to have smooth surfaces in order to prevent damage to the sensors and/or wiring on edges of the vessel 102 (i.e., fraying or other frictional damage). In other embodiments, the one or more sensor devices may be contained within the interior of the vessel 102 and not extend to the exterior. In these embodiments, vents, air tubes, and the like can be used to expose the sensors to the surrounding environment.

As illustrated in the figures, in some embodiments, the fire detection device 100 further comprises a sensor cover 126 operably coupled to an exterior side of the vessel 102 from which one or more of the sensors extend. The sensor cover 126 may at least partially house the sensors while allowing the sensors to sample conditions of the environment. In one embodiment, the sensor cover 126 may provide an extension of the interior cavity formed by the vessel, wherein the sensors may be at least partially positioned. In one embodiment, the sensor cover 126 only exposes a collector of a sensor to the external environment while housing and protecting the remaining portions of the sensor. In this way, the sensor cover 126 may provide additional protection to the sensors from environmental conditions (e.g., fire, weather, wildlife, and the like) while still allowing for environmental data collection. The sensor cover 126 may be constructed from materials similar to those of the vessel 102 as previously described herein. In some embodiments, the sensor cover 126 may be shaped (e.g., 3D printed) to accommodate a particular sensor or combination of sensors while minimizing unnecessary exposure of the sensor to the environment (i.e., for data collection).

Figure 5:
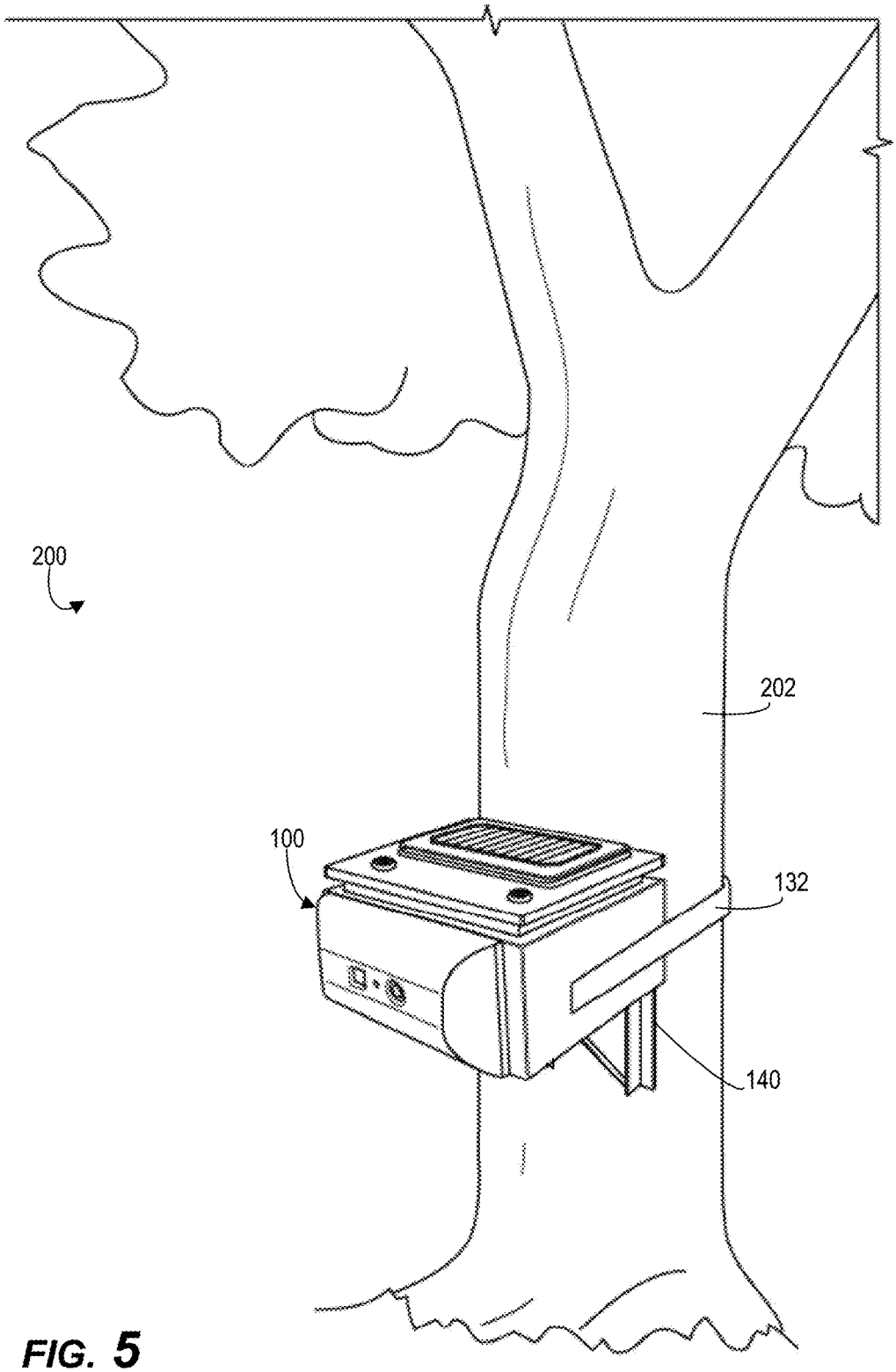
FIG. 5 depicts a perspective view of a fire detection device positioned within an environment, in accordance with one embodiment of the invention.
Figure 6:
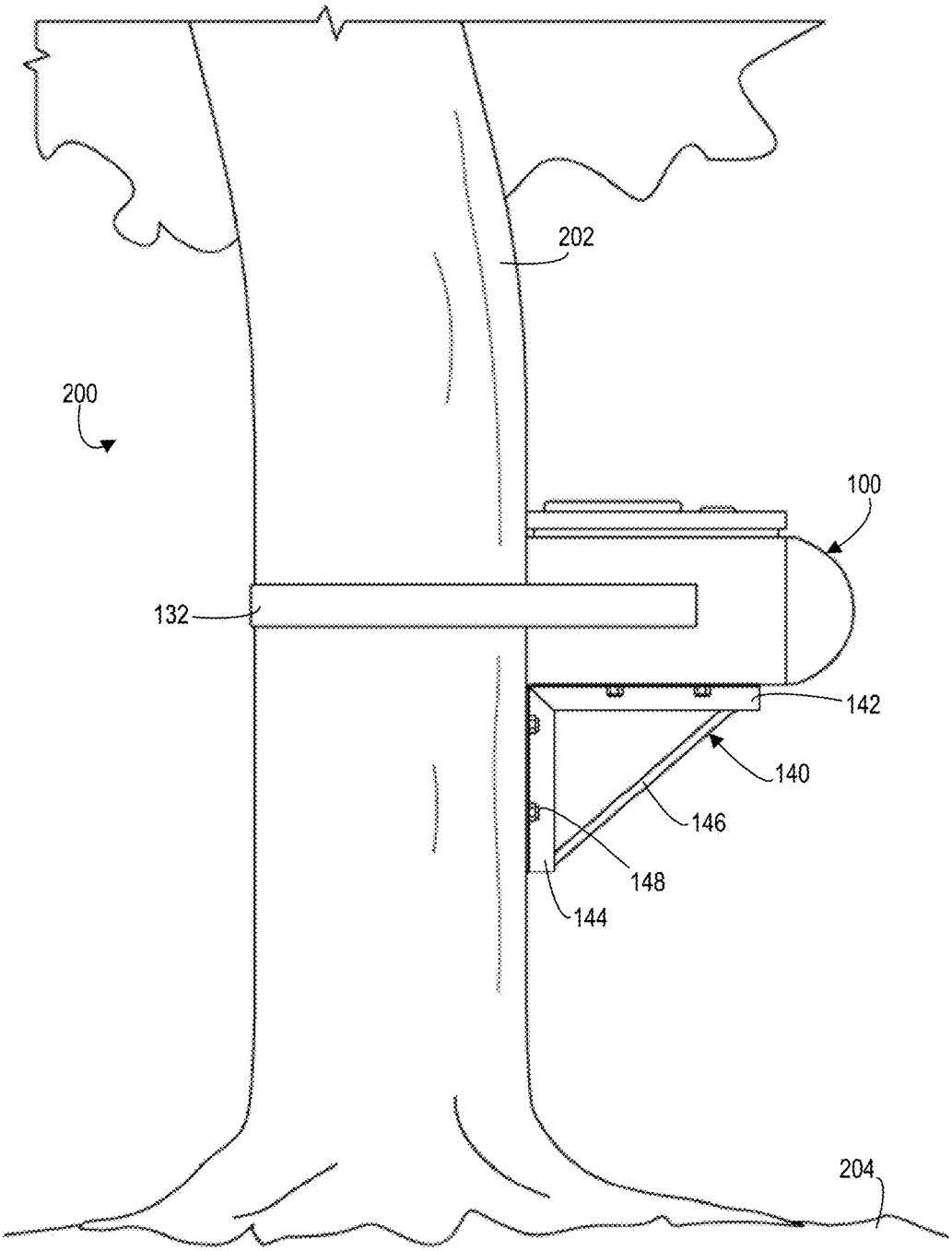
FIG. 6 depicts a side view of a fire detection device positioned within an environment, in accordance with one embodiment of the invention.

FIGS. 5 and 6 provide views of the fire detection device 100 positioned within an environment 200, in accordance with some embodiments of the invention. In some embodiments, the fire detection device 100 may be positioned within an environment 200 by being mounted to a surface, such as the surface of a tree 202. The fire detection device 100 may further include a support frame 140 for at least partially supporting and securing the fire detection device 100 to the surface. As illustrated in FIGS. 5 and 6, the support frame 140 comprises device support portion 142 and a surface engaging portion 144. In some embodiments, the device support portion 142 provides a platform that receives the fire detection device 100. In some embodiments, the surface engaging portion 144 may include one or more legs that engage the surface. In one embodiment, the device support portion 142 and the surface engaging portion 144 are positioned approximately perpendicular to one another in order to provide a substantially horizontal surface with the device support portion 142 while the surface engaging portion 144 engages a substantially vertical surface (e.g., the surface of a tree). In some embodiments, the support frame 140 may further include one or more braces 146 extending between the support portion 142 and the surface engaging portion 144 to provide additional support and distribute the weight of a fire detection device 100 mounted on the device support portion throughout the support frame. In some embodiments, the support frame 140 may be operatively coupled to the fire detection device 100 and/or the surface via one or more attachment means 148 (e.g., bolts, screws, spikes, adhesives, and the like).

In some embodiments, the fire detection device 100 may further include a strap 132 detachably coupled to one or more sides of the vessel 102. In some embodiments, the strap 132 may be positioned around an object (e.g., the trunk of a tree 202) in an environment 200 in order to at least partially secure and stabilize the fire detection device 100 to the object. In some embodiments, the strap 132 may be a ratcheting strap, wherein the strap may be tightened around the object to further secure the fire detection device 100 to the object. In another embodiment, the strap 132 may be elastic or have elastic properties (e.g., a bungee).

In some embodiment, the fire detection device 100 is positioned in the environment 200 on a surface of an object (e.g., tree 202) above the ground 204. In a particular embodiment, the fire detection device is positioned at eye level (approximately 5 feet off the ground). In other embodiments, the fire detection device 100 may be placed on a surface (e.g., surface 204, the ground, a rock, an elevated surface, or the like) in the environment 200 without the support frame 140 and/or strap 132.

While in the illustrated embodiments, the fire detection device 100 is positioned so that the solar panel 120 is approximately perpendicular to the ground 204, it should be understood that the fire detection device 100 may be positioned in alternative orientations. In one example, the fire detection device may be positioned where the solar panel 120 is oriented approximately perpendicular to the ground 204. Other locations, heights, surfaces, and orientations for positioning the device are further contemplated herein.

Figure 7:
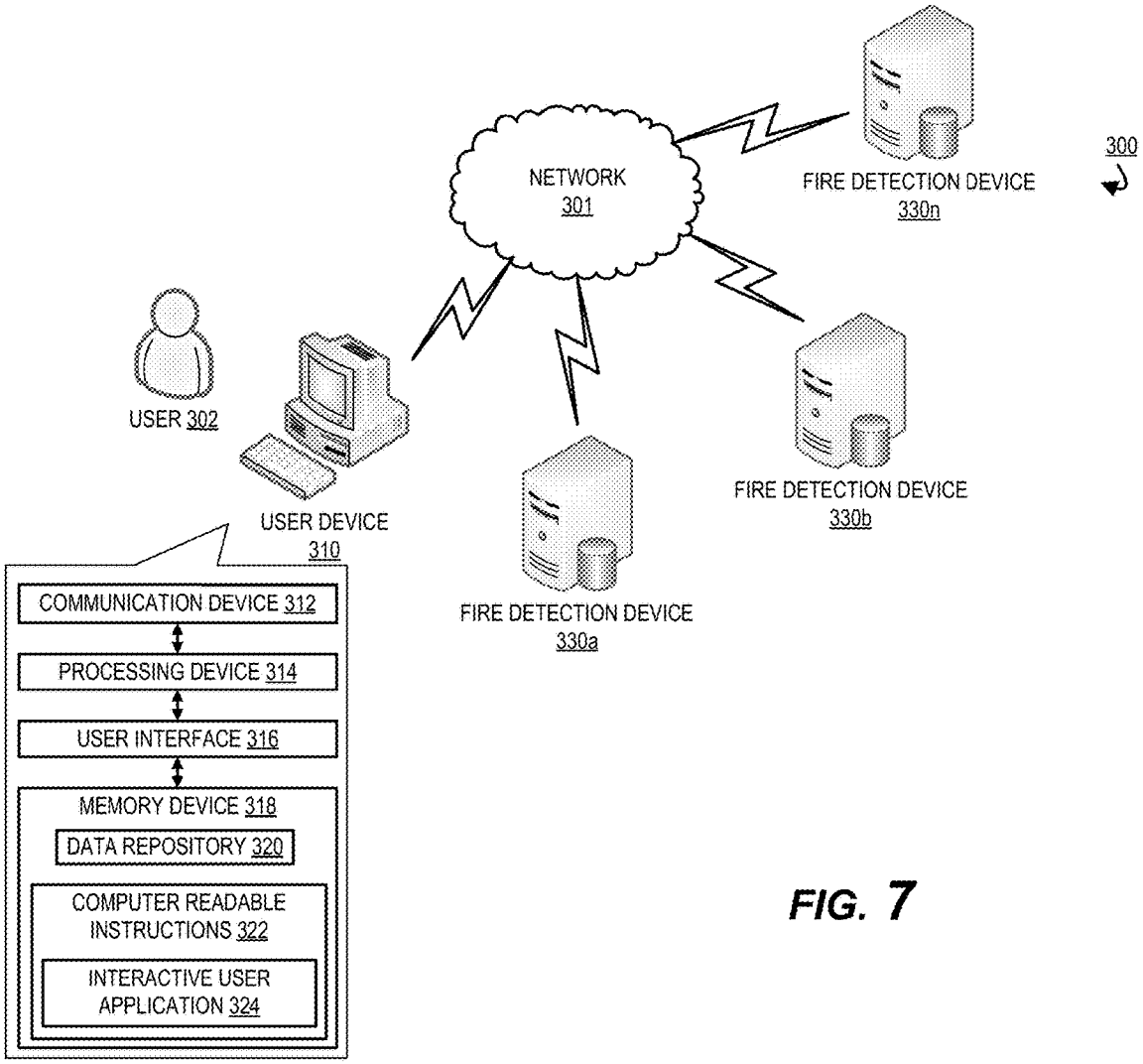
FIG. 7 depicts a system environment of a fire detection device, in accordance with one embodiment of the invention.

FIG. 7 depicts a system environment comprising one or more fire detection devices **300*a*-300*n*, in accordance with one embodiment of the invention in communication with at least one user device 310 via a network 301. FIG. 7 further depicts the various components of a user device 310, while FIG. 8, discussed later below, depicts the various components of a fire detection device 400** according to one or more embodiments of the present invention.

With regard to the discussion of the various components of the user device 310 and the fire detection device 400, the following general description of various electronic components is provided. As used herein, a "processing device," such as the processing devices 314, 410 and other processing devices discussed herein, generally refers to a device or combination of devices having circuitry used for implementing the communication and/or logic functions of a particular system. For example, a processing device may include a digital signal processor device, a microprocessor device, and various analog-to-digital converters, digital-to-analog converters, and other support circuits and/or combinations of the foregoing. Control and signal processing functions of the system are allocated between these processing devices according to their respective capabilities. The processing device may further include functionality to operate one or more software programs based on computer-executable program code thereof, which may be stored in a memory. As the phrase is used herein, a processing device may be "configured to" perform a certain function in a variety of ways, including, for example, by having one or more general-purpose circuits perform the function by executing particular computer-executable program code embodied in computer-readable medium, and/or by having one or more application-specific circuits perform the function.

As used herein, a "user interface" such as the user interface 316 and other user interfaces discussed herein, generally includes a plurality of interface devices and/or software that allow a customer to input commands and data to direct the processing device to execute instructions. For example, the user interfaces presented herein may include a graphical user interface (GUI) or an interface to input computer-executable instructions that direct the processing device to carry out specific functions. The user interface employs certain input and output devices to input data received from a user or output data to a user. These input and output devices may include a display, mouse, keyboard, button, touchpad, touch screen, microphone, speaker, LED, light, joystick, switch, buzzer, bell, and/or other customer input/output device for communicating with one or more customers. In some embodiments, the user interface may be a separate handheld device that communicates with the processing devices via a detachable cable and connector to provide input. This may be useful for the fire detection device in particular, as it would forgo the need for an embedded user interface, but still allow a user to configure the device via the handheld interface.

As used herein, a "memory device" or "memory" such as memory devices 318, 430 and others described herein, generally refers to a device or combination of devices that store one or more forms of computer-readable media for storing data and/or computer-executable program code/instructions. Computer-readable media is defined in greater detail below. For example, in one embodiment, the memory device includes any computer memory that provides an actual or virtual space to temporarily or permanently store data and/or commands provided to the processing device when it carries out its functions described herein.

As used herein, a "communication interface" or "communication device" generally includes a modem, server, transceiver, and/or other device for communicating with other devices on a network, and/or a user interface for communicating with one or more customers. The communication devices discussed herein, such as 312 and 440, are communication interfaces having one or more devices configured to communicate with one or more other devices on a network, such as a mobile device, a personal computing device, a responder dispatch system, third party systems, and/or the like. The processing device is configured to use the network communication device to transmit and/or receive data and/or commands to and/or from the other devices connected to the network.

The interactive user application 324, as well as other applications discussed herein, are for instructing the processing devices on their respective systems to perform various steps of the methods discussed herein, and/or other steps and/or similar steps. In various embodiments, one or more of the various applications discussed are included in the computer readable instructions stored in a memory device of one or more systems or devices other than their respective systems and/or devices. In these embodiments, the applications may be accessed and operated via the network without requiring the application to be resident on a particular device. In some embodiments, the discussed applications may be similar and may be configured to communicate with one another. In some embodiments, the various applications may be considered to be working together as a singular application despite being stored and executed on different systems.

In various embodiments, any of the systems discussed herein may be more than one system and the various components of the system may not be collocated, and in various embodiments, there are multiple components performing the functions indicated herein as a single device. For example, in one embodiment, multiple processing devices may be employed to perform the functions of the depicted processing device 314.

In various embodiments, the user device 310, fire detection device 330, and/or other systems may perform all or part of a one or more method or process steps discussed herein and/or other method steps in association with the method steps discussed herein. Furthermore, some or all the systems/devices discussed here, in association with other systems or without association with other systems, in association with steps being performed manually or without steps being performed manually, may perform one or more of the steps of one or more of the method discussed herein, or other methods, processes or steps discussed herein or not discussed herein.

The systems and devices communicate with one another over the network 301 and perform one or more of the various steps and/or methods according to embodiments of the disclosure discussed herein. The network 301 may include a local area network (LAN), a wide area network (WAN), and/or a global area network (GAN). The network 301 may provide for wireline, wireless, or a combination of wireline and wireless communication between devices in the network. In some embodiment, the network 301 includes the Internet, cellular networks, radio communications, satellite networks, Bluetooth, near field communication, infrared, audio and/or the like.

Referring now again to FIG. 7 in light of the understanding of the components discussed above, the user device 310 of one embodiment includes a communication device 312 communicably coupled with a processing device 314, which is also communicably coupled with a memory device 318. In some embodiments, the communication device 312 may also comprise a global positioning system (GPS) transceiver capable of determining a geographic location associated with the user device 310. The processing device 314 is configured to control the communication device 312 such that the user device 310 communicates across the network 301 with the one or more fire detection devices 330*a*-330*n*. The processing device 314 is also configured to access the memory device 318 in order to read the computer readable instructions 322, which in some embodiments includes an interactive user application 324. The interactive user application 324 allows for communication of the user device 310 with the other systems and devices within the system environment 300 such as the fire detection device 330 and the alert processing system 350. The interactive user application 324 allows the user 302 to receive information transmitted as well as input information requested by the other systems and communicate with and transmit information (e.g., commands, instructions, notifications, messages) to the other systems, devices, one or more third parties, and/or other entities. In some embodiments, the interactive user application 324 further allows the user 302 to track potential or current fires as detected by a network of one or more of the fire detection devices as described herein. The memory device 318 also includes a data repository 320 or database for storing pieces of data that can be accessed by the processing device 314. In some embodiments, the data repository 320 further comprises a repository of contact information (e.g., phone numbers, email addresses, and other connection lines) of one or more users of the system, such as first responders, elected officials, municipality employees, media outlets, and the like to communicate alerts and fire conditions either manually or electronically to these individuals and entities.

Figure 8:
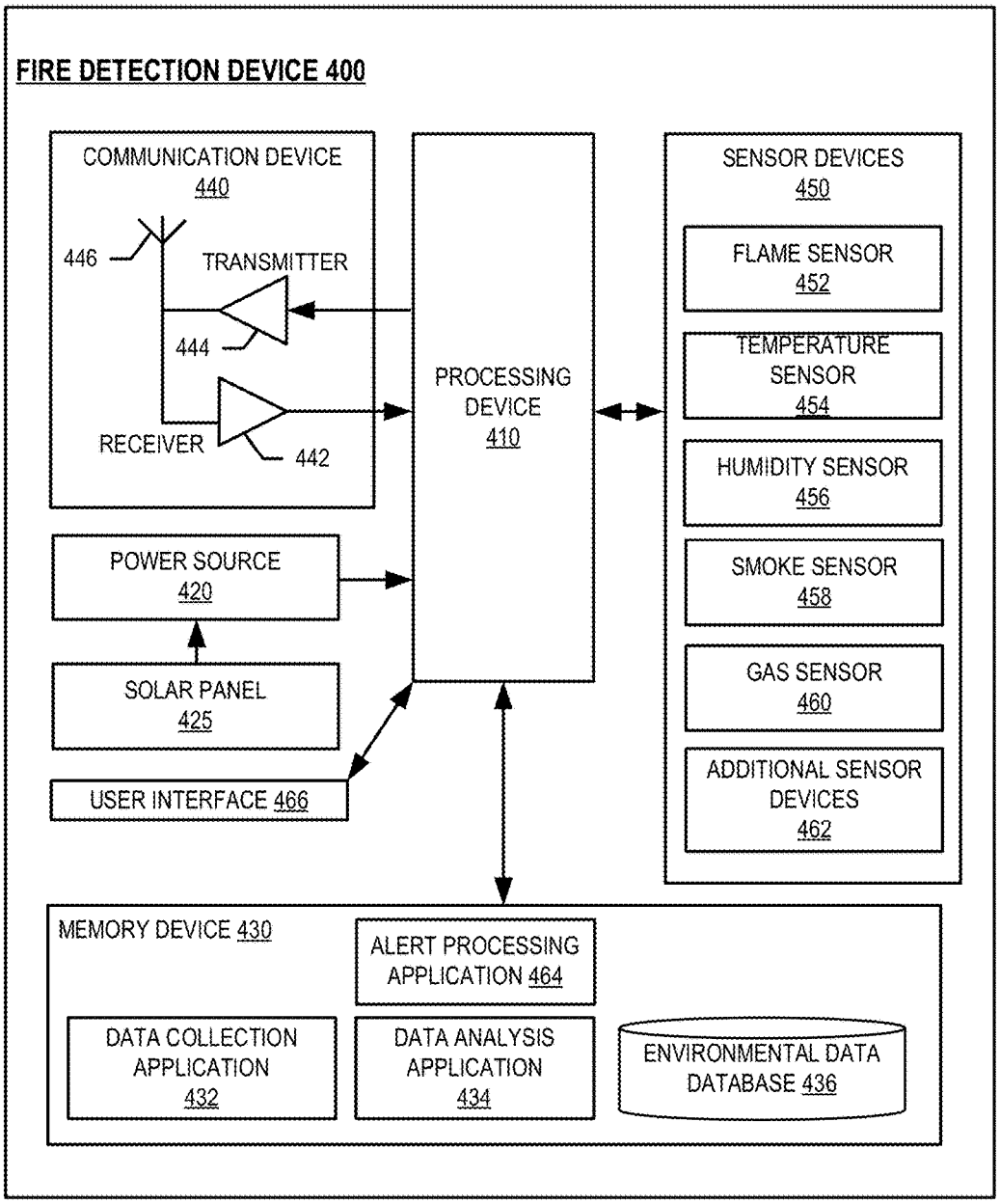
FIG. 8 depicts a schematic of a fire detection device, in accordance with one embodiment of the invention.

FIG. 8 depicts a schematic of a fire detection device 400, in accordance with one embodiment of the invention. As previously discussed, the fire detection device 400 is used to measure and monitor environmental conditions to determine the presence of a fire and transmit collected data and alerts to other systems and/or devices. The fire detection device 400 typically includes a processing device 410, memory device 430 with storage memory for the storage of data (e.g. environmental data 436), and a communication device 440. As such, the fire detection device 400 and the processing device 410 in particular, are configured to perform at least a portion of the steps of the embodiments described herein, either based on executing computer readable instructions stored in the memory device 430, and/or based on receiving instructions, indications, or signals from other systems and devices such as the user device 310 and sensor devices 450, and/or other systems. In some embodiments, the user device 310 is configured to transmit control instructions to, and cause the processing device 410 to perform one or more steps of the embodiments presented herein.

The fire detection device may further comprise various components/devices in operative communication with and/or controlled by the processing device 410, such as sensor devices 450, communication device 440, a power source 420, memory device 430, and the like. Furthermore, in some embodiments, the processing device 410 is operatively coupled to and is configured to control other components/devices of the computer terminal fire detection device, such as the sensor devices.

The memory device 430 and the storage memory may generally refer to a device or combination of devices that store one or more forms of computer-readable media for storing data and/or computer-executable program code/instructions. In some embodiments, the storage memory is integral with the memory device 430. In some embodiments, the memory device 430 comprises a non-transitory, computer readable storage medium. For example, the memory device 430 and/or the storage memory may include any computer memory that provides an actual or virtual space to temporarily or permanently store data and/or commands provided to the processing device 410 when it carries out its functions described herein.

As illustrated by FIG. 8, the memory device 430 typically comprises a data collection application 432, a data analysis application 434, alert processing application 464 and environmental data 436 stored therein. In some embodiments, the data collection application 432 is integral with the data analysis application 434. In some embodiments, the data collection application 432, data analysis application 434, and/or the alert processing application 464 may be executable to initiate, perform, complete, and/or facilitate one or more portions of any embodiment described and/or contemplated herein, either independently or in response to receiving control instructions from the user device 310. In some embodiments, the data collection application 432, data analysis application 434, and/or the alert processing application 464 comprise computer readable instructions stored in the memory device 430, which when executed by the processing device 410, are configured to cause the processing device 410 to perform one or more steps of the embodiments presented herein, and/or cause the processing device 410 to transmit control instructions to other components or devices of the fire detection device 400 and/or other devices/systems in the network 301 to cause them to perform the steps. Generally, the data collection application 432 is executable to receive data collection settings and instructions from the user 302 and collect and store environmental data using the sensor devices as described by the various steps herein. The data collection application 432 may be coupled to an environmental data database 436 for storing environmental data as data collection is performed by the sensor devices. The data analysis application 434 may perform various calculations on the collected data as discussed previously and later below to detect the presence of a fire. In the instances where fire is detected, the alert processing application 464 transmits signals, data, and/or alerts or notifications to one or more of the other systems described herein for alerting users of a fire.

The communication device 440 may comprise a receiver 442, a transmitter 444, transceiver, and/or another device for communicating with other devices and systems on the network 101. The communication device 440 may further comprise wireless and/or wired interface that is configured to establish communication between components of the fire detection device 400 and/or between the fire detection device, particularly the processing device 410, and other devices or systems, such as the user device 310 and/or one or more third party systems, and the like. In this regard, the communication device 440 comprises a transmitter 444, a receiver 442, and a broadcasting device 446 to transmit and receive signals from corresponding devices via a suitable transmission medium or a communication channel. In some embodiments, the fire detection device 400 is configured to be coupled/connected to other devices and systems via wired communication channels. In other embodiments, the fire detection device 400 is configured to be coupled/connected to other devices via a wireless channel. In this regard, the wireless communication channel may comprise near field communication (NFC), communication via radio waves, communication through the Internet, communication via electromagnetic waves and the like.

Establishing the communication channels may also include signaling information in accordance with the air interface standard of the applicable cellular system of the wireless telephone network that may be part of the network 301. In this regard, the fire detection device 400 may be configured to operate with one or more air interface standards, communication protocols, modulation types, and access types. By way of illustration, the fire detection device 400 may be configured to operate in accordance with any of a number of first, second, third, and/or fourth-generation communication protocols and/or the like. For example, the fire detection device may be configured to operate in accordance with second-generation (2G) wireless communication protocols IS-136 (time division multiple access (TDMA)), GSM (global system for mobile communication), and/or IS-95 (code division multiple access (CDMA)), or with third-generation (3G) wireless communication protocols, such as Universal Mobile Telecommunications System (UMTS), CDMA2000, wideband CDMA (WCDMA) and/or time division-synchronous CDMA (TD-SCDMA), with fourth-generation (4G) wireless communication protocols, and/or the like. The fire detection device 400 may also be configured to operate in accordance with non-cellular communication mechanisms, such as via a wireless local area network (WLAN) or other communication/data networks.

As illustrated by FIG. 8, the computer terminal may further comprise sensor devices 450. In some embodiments, the processing device 410 communicates with, transmits instructions, and/or receives signals from the sensor devices 450, in real-time for determining trigger events (e.g., presence of a flame or smoke) and capturing one or more parameters (e.g., temperature, humidity, combustion gases, wind speed) associated with the environment or physical location of the fire detection device 400. For example, the sensor devices 450 may comprise one or more of a flame sensor 452, temperature sensor 454 (such as a thermocouple), humidity sensor 456 (such as a hygrometer), a smoke sensor 458, one or more gas sensors 460, as well as additional sensor devices 462 such as an anemometer, weather vane, wind speed detector, an image capture device, a sound recording device, a geolocation device, a weather sensing device, a proximity sensor, radio frequency sensor, pressure sensor, a pH sensor, radiation measurement and detection devices (e.g., a Geiger counter and/or the like), biological contaminant sensing devices, a photoelectric sensor, a capacitance sensor, an electric field sensor, a magnetic field sensor, a piezoresistive or piezoelectric sensor, and the like. In some embodiments, one or more of the sensor devices may be combined into a single sensor. For example, the fire detection device may include a device such as a DHT22 temperature and humidity sensor sold under the brand name of Evazstyle™, which is capable of measuring both temperature and humidity.

Figure 9:
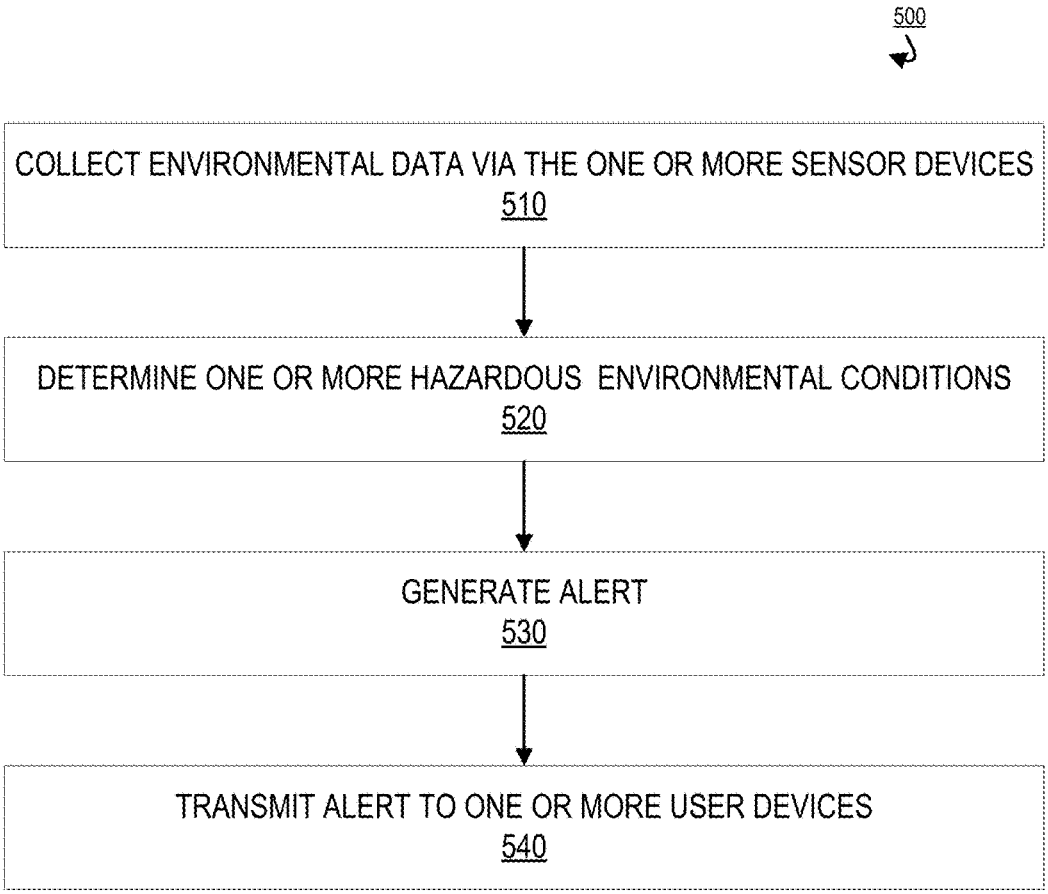
FIG. 9 depicts a high level process flow for detection and notification of a fire, in accordance with one embodiment of the invention.

FIG. 9 depicts a high level process flow for detection and notification of a fire 500, in accordance with one embodiment of the invention. As illustrated in block 510, the system, using the data collection application 432, first collects environmental data via the one or more sensor devices. As previously discussed, the various sensor devices (e.g., temperature, humidity, flame, smoke, gas sensor) of the fire detection device collect environmental data in the form of collected signals which are processed and analyzed to monitor the various environmental conditions of the environment (e.g., humidity, temperature, and the like) in which the fire detection device is located. In some embodiments, collected environmental data may be stored in a structured table or database 436 for further reference. In some embodiments, collected data may be automatically and routinely transmitted to a remote user device upon collection to reduce the possibility of lost data in the case of fire detection device failure.

As illustrated in block 520, the system, using the data analysis application 434, next determines the presence of one or more environmental conditions determined to be hazardous or potentially hazardous to the environment or public based on the collected environmental data (e.g., a detected forest fire by detecting flames, smoke, combustion gases or conditions that may encourage a forest fire (e.g., low humidity and high temperature)). The system may determine one or more detected environmental conditions to be hazardous based on predetermined limits of the various environmental conditions. For example, a temperature exceeding a threshold of 100° F. may trigger a determination of hazardous environmental condition (i.e., temperature) and then trigger the transmission of data and an alert to one or more other systems and/or devices as described herein. Likewise, a high temperature reading coupled with a low humidity reading may trigger an alert. In some embodiments, use of algorithms or use of empirical data models may be employed that assess measurements of various environmental parameters that are known within certain conditions to indicate fire or environmental conditions where fire may be imminent. The data models may be based on general parameters that indicate the presence of fire or the data models may include more complex parameters, such as fire history for the geographic region where the fire detection device is located, past rain/snow fall for the location or other local conditions that may assist in determining whether fire is present or conditions are such that a fire is likely to occur. In other words, a location that has experienced fires in the past, has had little rain fall, and is prone to high winds, lightning, and other factors that may facilitate fire may be monitored more closely and have lower threshold trigger conditions associated with transmission of alerts.

As illustrated in block 530, the system generates an alert using the data analysis application 464, and, as illustrated in block 540, transmits the alert to one or more user devices. The alert generation and/or transmission may be triggered by the detection of the one or more hazardous environmental conditions. The system may generate and/or transmit the alert based on one or more of the signals and data collected by the sensor devices of the fire detection device. For example, the fire detection device may detect the presence of a flame and a high temperature and determine to generate and transmit the alert. However, in another example, the fire detection device may not detect the presence of flame but only detect a high temperature (e.g., auto-ignition temperature of one or more materials) that would indicate the presence or possibility of a fire. In this case, the system may determine to generate and/or transmit the alert based on only the measured temperature even though no flame has been detected by the flame sensor.

The alert may be a notification, text message, email, automated phone call, computer code or command, radio frequency transmission, and/or other transmitted signal that is transmitted to one or more user devices to notify the users of the hazardous environmental conditions (e.g., a forest fire). In some embodiments, the alert may be transmitted to a responder dispatching system, emergency broadcast system, or the like.

In some embodiments, the invention may comprise a network of a plurality of fire detection devices positioned in an area and in communication with one another and/or the systems described herein. In some embodiments, the plurality of fire detection devices may persistently monitor environmental conditions within an environment. In other embodiments, the plurality of devices may remain in a dormant or low-power state until the one or more devices receive instructions or are triggered (e.g., by received communication or detected conditions) to initiate operations and/or one or more of the processes or tasks described herein. In some embodiments, at least a portion of the plurality of fire detection devices may remain in a dormant or low-power state until receiving a transmission or control signal from one or more active fire detection devices. In this way, the entirety of the fire detection networked device may not be required to be persistently in a full-powered state, thus conserving energy. For example, a first fire detection device actively monitoring a first portion of an environment may detect one or more hazardous or potentially hazardous environmental conditions (e.g., high temperature, presence of flame, and/or the like). In response, the first fire detection device may transmit a control signal to one or more additional, dormant fire detection devices to power on and collect environmental data. In some embodiments, the first fire detection device may transmit or relay signals to one or more fire detection devices in a path or direction of a detected hazard as determined by the one or more sensor devices and/or systems described herein. The availability of data from the network of fire detection devices may also be useful in identifying heat maps and hot spots of the fire so as to assist responders in focusing on critical areas of the fire. In some embodiments, where there is an active fire, fire detection devices not detecting fire may actively transmit information indicating no fire in their area to the user devices so as to aid in isolating the area/spread pattern of the fire.

In the discussion of block 520 above, it is described as the fire detection device analyzing the data and determining hazardous environmental conditions. In some instances, it may be worthwhile implementing a centralized processing system that is separate from the fire detection devices and is located on the network for performing some or all of the analysis functions for some or all of the fire detection devices in the network. This would allow each individual fire detection device to conserve energy and possibly require less processing power. In this embodiment, the one or more fire detection devices would collect environmental data from the sensors and analyze the data to initially determine a fire detection condition. The fire detection device would then begin to transmit the collected environmental data to the central processing system. The central processing system would then take over analysis of subsequently collected environmental data from one or more of the fire detection devices, and then subsequently send alerts to the user device 310 or other alert systems in the network regarding the fire detection. As an alternative to a separate central processing system, the system may employ other fire detection devices in the network to analyze environmental data and transmit alerts. For example, if a fire detection device has sensed fire and it is critical that the fire detection device use all processing time and energy to collect environmental data, then the fire detection device may send collected environmental data to one or more other fire detection devices in the network for analysis and alarm generation. By assuming the responsibility of analyzing the environmental data at the central processing system or at another fire detection device, the fire detection devices in the affected area can possibly conserve energy (extend battery life) by only collecting and transmitting data.

In some embodiments, the fire detection devices may only transmit collected environmental data to the alert processing system in response to determining one or more hazardous environmental conditions. In some embodiments, the system may constantly monitor and transmit environmental data regularly even if environmental conditions are not considered hazardous. In this way, data may be routinely processed and analyzed to track historical environmental conditions and generate an environment profile. In some embodiments, the system may use the tracked historical environmental conditions and environment profile to determine baseline conditions for the environment. In some embodiments, the system may further automatically generate thresholds for abnormal or hazardous environmental conditions based on the historical environmental conditions and environmental profile.

Figure 10:
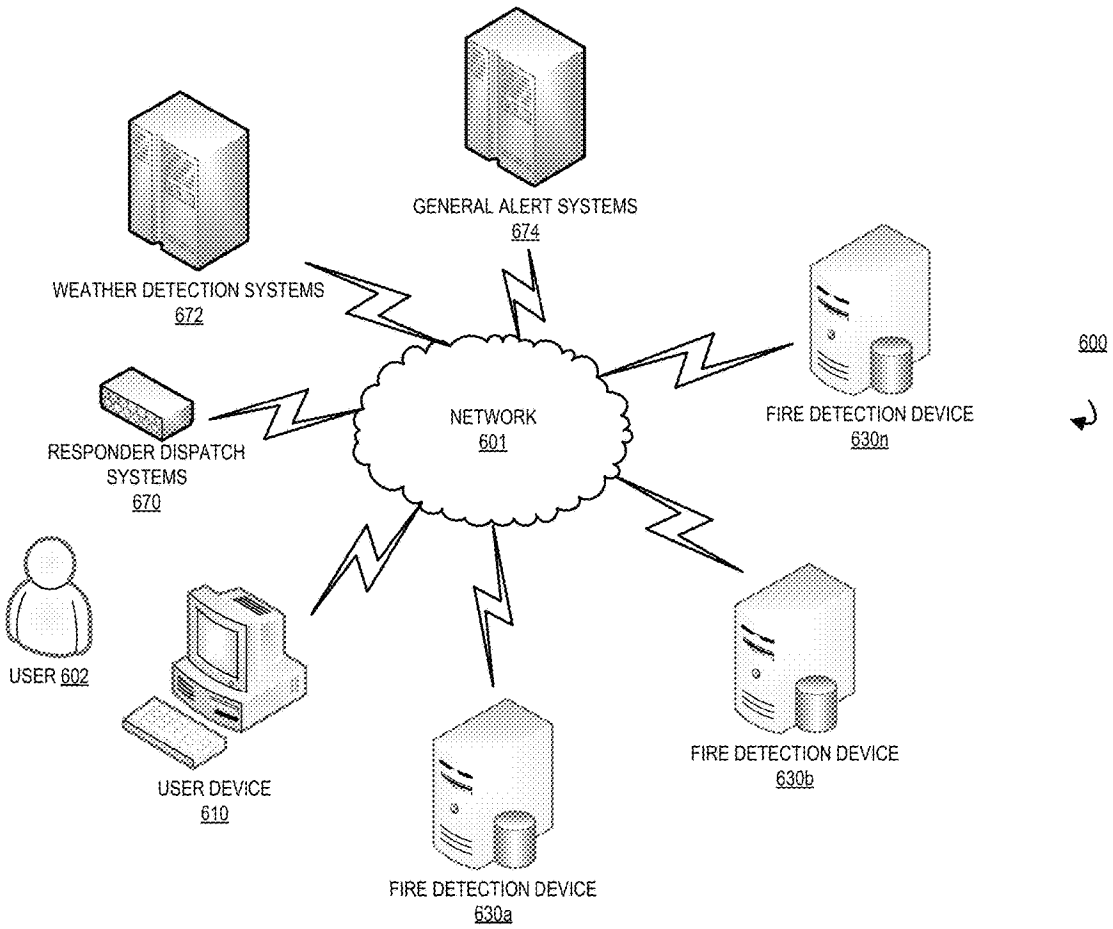
FIG. 10 depicts a system environment of a fire detection device notification system, in accordance with another embodiment of the invention.

FIG. 10 depicts another system environment, in which fire detection devices 630*a*-630*n* according to one embodiment of the present invention may optionally be capable of communicating with a plurality of different types of user devices and alert systems. For example, in addition to user interfaces 610 (similar to the one depicted as 310 in FIG. 7), the fire detection devices 630*a*-630*n* may directly communicate with other alert devices, such as responder dispatch systems 670. In some embodiments, the responder dispatch systems 670 may include the same components and functionality as the user device 610 and be able to provide a first responder with detailed information and the ability to communicate commands to one or more of the fire detection devices. However, in some embodiments, the responder dispatch systems 670 may be simplified systems with less functionality for more cost affordable use and easier deployment to first responders in the field. In these instances, the responder dispatch systems 670 may be limited to capabilities of communicating with the fire detection devices and providing basic information about fire conditions and location and an ID for identifying one or more particular fire detection devices providing alarms regarding fire conditions.

Also, as depicted in FIG. 10, the fire detection devices 630*a*-630*n* may be capable of communicating with weather detection systems 672 to provide fire detection and conditions information. In some embodiments, the fire detection devices may provide fire alert and fire condition data to such weather detection systems during a fire event for providing alerts to residents via radio and television media coverage. As discussed above, the fire detection devices may be capable of providing sensor data to a system such as the depicted weather detection system or the central processing system discussed above on a periodic basis where there is no immediate fire condition, where such data is used for prediction and modeling of future fire events.

Still further, the fire detection devices 630*a*-630*n* may be capable of communicating with general alert systems 674, such as municipality alert systems that deploy sirens and other broadcasts means to alert residents of fire conditions.

Figure 11:
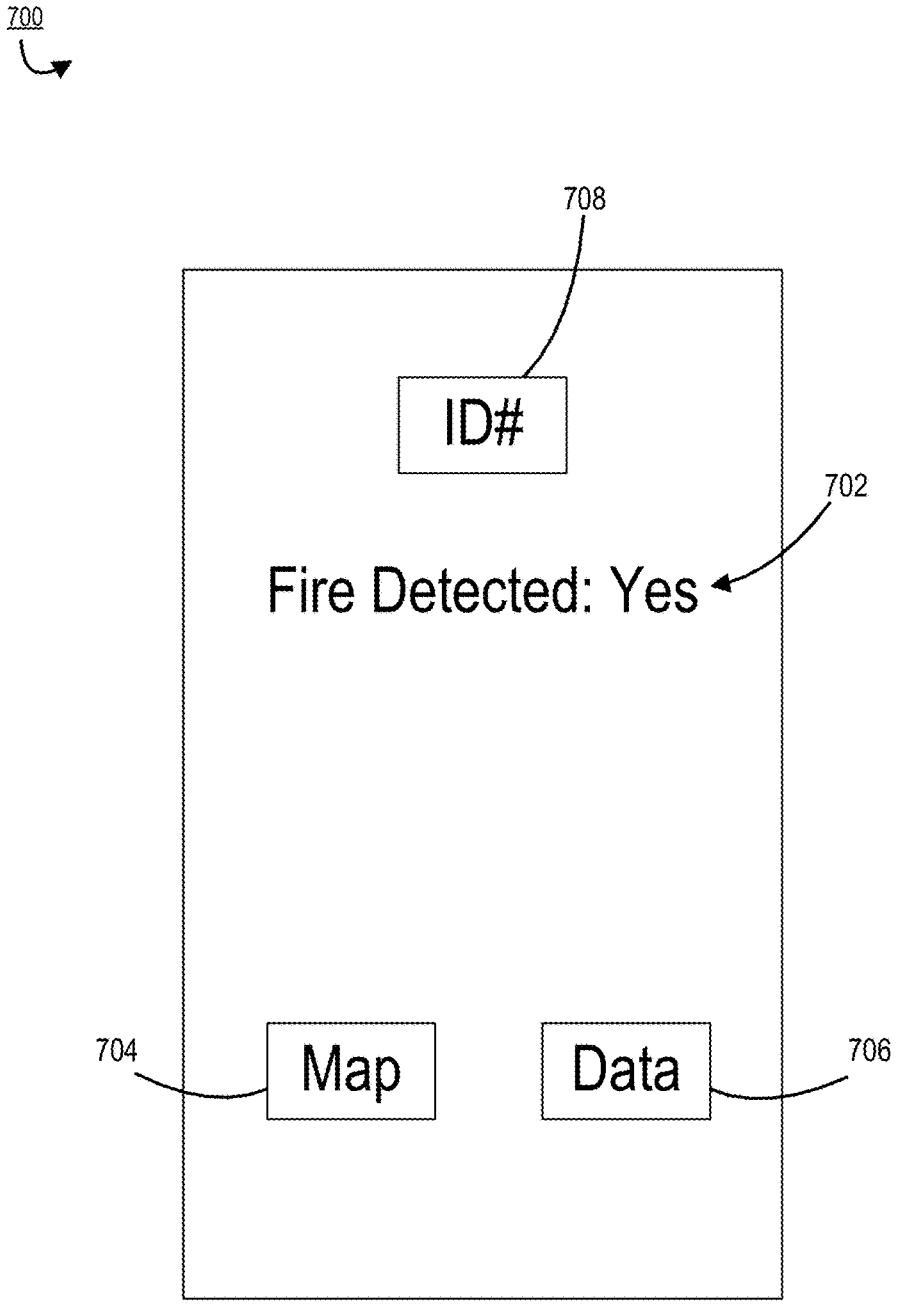
FIG. 11 depicts a graphical representation of a portion of an interactive user application, in accordance with one embodiment of the invention.

FIG. 11 depicts a graphical representation of a portion of an interactive user application 700, in accordance with one embodiment of the invention. In some embodiments, the portion of the interactive user application 700 may be a home screen of the application that is seen by a user first logging onto the application. In some embodiments, the interactive user application may require that a user provide authentication information or credentials to login to the application. As illustrated by FIG. 11, the interactive user application may present the user with a status 702 of any potential or confirmed fires detected by the fire detection device, wherein the status 702 may report a positive or negative status as to the current presence of a potential or detected fire. In some embodiments, the application may provide the user with a status warning of an increased probability of a fire based on measured environmental conditions (e.g., low humidity and high temperature). The interactive user application further comprises a map button 704 and a data button 706 which provide additional information upon user interaction with said buttons. Optionally, if the system has more than one fire detection device employed, the ID or IDS 708 of the fire detection devices that have triggered an alert are displayed so as to identify the fire detection device and its location.

Figure 12:
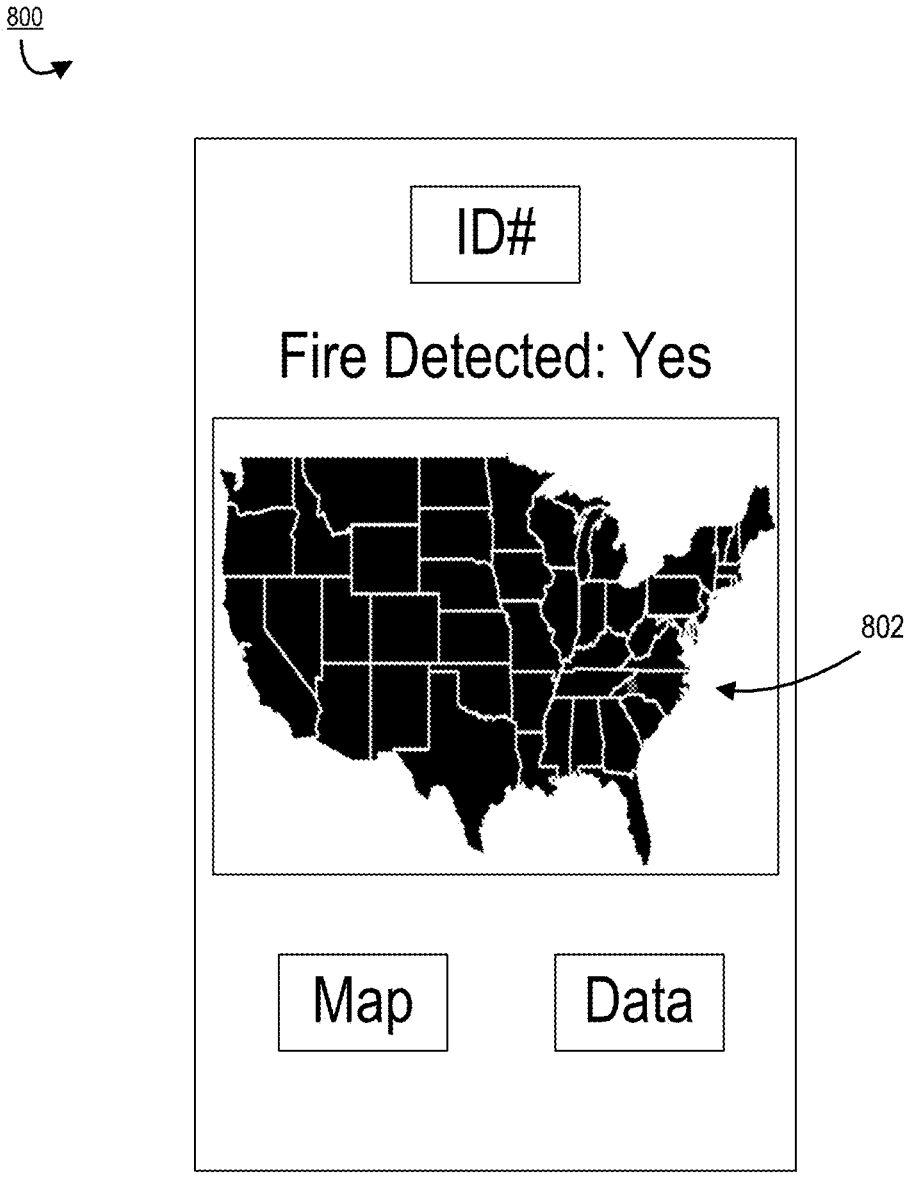
FIG. 12 depicts a graphical representation of a map portion of an interactive user application, in accordance with one embodiment of the invention.

FIG. 12 depicts a graphical representation of a map portion of an interactive user application 800, in accordance with one embodiment of the invention. In some embodiments, the interactive user application generates and provides a geographical map 802 of a location or area in response to user interaction with the map button 704. In some embodiments, the map 802 may be populated in real time with one or more distinguishing visual alerts (e.g., colors, shapes, symbols) overlaid or within the map to identify a location of one or more detected fires. In some embodiments, the map 802 allows the user to select a location within the map 802 to view the current environmental conditions associated with the selected location even if there is no fire currently detected at the selected location. In some embodiments, populated and/or selectable locations within the map 802 correspond to locations of one or more networked fire detection devices.

In some embodiments, the invention may map an area based on the collected environmental data received from a network of a plurality of fire detection devices to gain a holistic view of a monitored area or environment, wherein the plurality of fire detection devices may be positioned throughout the area or environment to provide sufficient and accurate coverage (i.e., spaced uniformly throughout the area in a grid or the like).

In further embodiments, the invention may designate or mark specific areas or interest within a monitored environment based on the environmental conditions detected at specific fire detection devices within the network of devices. For example, within a monitored area, the invention may determine that only a portion of the area received rainfall, while the remaining portion has not received rainfall and presents conditions with increased likelihood for a fire (e.g., low moisture content). In response, the invention may designate this dry area on a map and apply additional, specific rules or conditions to the designated area. For example, the system or a user of the system may provide specific operating instructions to the fire detection devices within the designated area or implement a burn warning, fire building/burning restrictions (i.e., for residents, campers, hikers), and/or the like.

Figure 13:
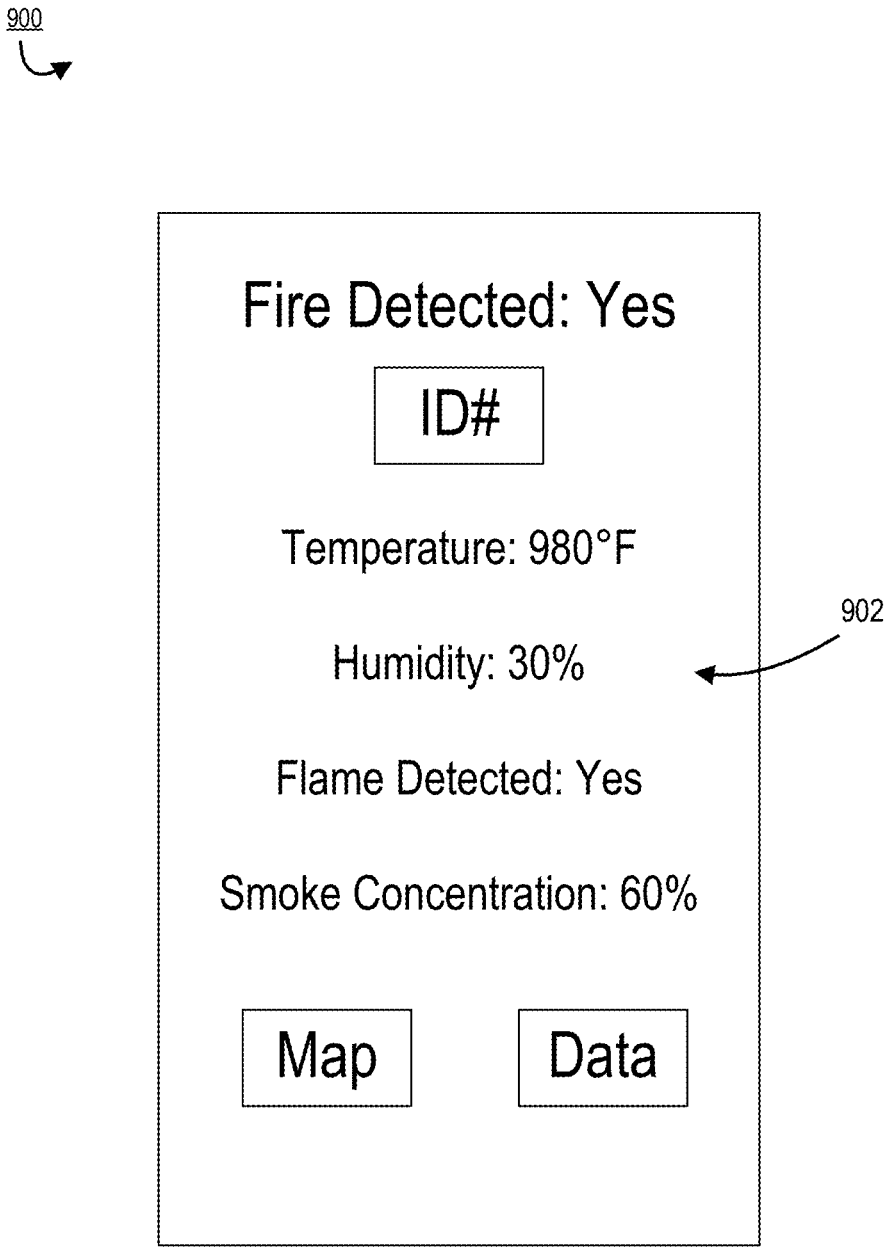
FIG. 13 depicts a graphical representation of a conditions portion of an interactive user application, in accordance with one embodiment of the invention.

FIG. 13 depicts a graphical representation of a conditions portion of an interactive user application 900, in accordance with one embodiment of the invention. In some embodiments, the interactive user application provides a report of environmental conditions 902 of a location corresponding to a fire detection device. For example, the interactive user application may report the temperature, humidity, smoke, and flame detector status and/or other environmental conditions detected through the collection of data by a fire detection device.

In some embodiments, the interactive user application further comprises a function for transmitting an alert or notification to another computing device (e.g., a responder dispatch system, a device of a family member, or the like). In this way, a user may alert additional users or the proper responders (e.g., firefighters, police, medical responders) of a detected fire from the user device. In some embodiments, the interactive user application may further receive and present to the user evacuation and safety instructions, status updates, and the like from authorities, responders, emergency broadcast systems and the like.

In some embodiments, the system may generate and transmit a notification based on the detection of failure of the fire detection device (e.g., device damage, destruction, battery failure/depletion/near-depletion, or the like). In some embodiments, the system may determine a failure of the fire detection device based on the interruption of collected data from one or more of the sensors and/or the interruption of communication between the fire detection device and one or more other systems and devices as described herein.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A fire detection device network comprising a plurality of fire detection devices configured to communicate over a network, each of the plurality of fire detection devices comprising:

at least one sensor device;

a memory device with computer-readable program code stored thereon;

a communication device configured to communicate via the network; and a processing device operatively coupled to the at least one sensor device, the memory device, and the communication device, wherein the processing device is configured to execute the computer-readable program code stored in the memory device to:

collect environmental data via the at least one sensor device;

determine a hazardous environmental condition based on the environmental data;

based on determining the hazardous environmental condition, generate an alert, wherein the alert comprises a location associated with at least one of the plurality of fire detection devices; and transmit the alert, wherein at least some of the plurality of fire detection devices are configured to remain in a dormant state until determining a hazardous environmental condition, and wherein a first fire detection device in an active state is configured to utilize processing power of a second fire detection device in the dormant state over the network.

2. The fire detection device network of claim 1, wherein said the processing device is further configured to execute the computer-readable program code to:

determine a hazardous environmental condition based on the environmental data;

based on determining the hazardous environmental condition, generate an alert, wherein the alert comprises both the environmental data and a location associated with at least one of the plurality of fire detection devices; and transmit the alert.

3. The fire detection device network of claim 1, wherein the hazardous environmental condition is transmitted from the first fire detection device in the active state to the second fire detection device in the dormant state, wherein receiving the hazardous environmental condition causes the second fire detection device to operate in the active state, and wherein the second fire detection device is configured to collect and processes environmental data in the active state.

4. The fire detection device network of claim 1, wherein the computing device comprises an interactive user application stored thereon configured to receive the environmental data.

5. The fire detection device network of claim 4, wherein the interactive user application is configured to generate a map based on the environmental data.

6. The fire detection device network of claim 1, wherein at least one of the fire detection devices further comprises:

a vessel forming an interior cavity;

a secondary enclosure positioned within the interior cavity and at least partially housing the at least one sensor, the secondary enclosure and the vessel forming a space therebetween; and a fireproof or fire resistant insulation positioned within the space.

7. The fire detection device network of claim 6, wherein the fireproof or fire resistant insulation is a sprayable foam insulation, the sprayable foam insulation expandable to fill the space.

8. The fire detection device network of claim 1, wherein the at least one sensor is selected from the group consisting of a humidity sensor, a gas sensor, an anemometer, a weather vane, a pressure sensor, a photoelectric sensor, a capacitance sensor, an electric field sensor, a magnetic field sensor, a piezoresistive or piezoelectric sensor, a pH sensor, an image capture device, a sound recording device, a proximity sensor, a motion sensor, a radio frequency sensor, a radiation sensing device, or a biological contaminant sensing device.

* * * * *